United States Patent [19]

Peuhkurinen et al.

[11] 4,413,495

[45] Nov. 8, 1983

[54] METHOD FOR THE STIFFENING AND STRAIGHTENING OF STARTING SHEETS

[75] Inventors: Eino J. Peuhkurinen, Kokkola; Erkki J. Linnanketo, Pori; Kari M. U. Färm, Vantaa; Tuomo V. J. Kivistö, Espoo; Tauno T. Koho, Helsinki; Seppo T. Kinnunen; Martti P. Taskinen, both of Espoo, all of Finland

[73] Assignee: Outokumpu Oy, Helsinki, Finland

[21] Appl. No.: 239,677

[22] Filed: Mar. 2, 1981

[30] Foreign Application Priority Data

Mar. 3, 1980 [FI] Finland ..... 800647

[51] Int. Cl.[3] ..... B21D 13/02; B21D 13/04; B21D 31/06; B21D 43/00

[52] U.S. Cl. ..... 72/196; 72/199; 72/251; 72/379; 72/414; 72/422

[58] Field of Search ..... 72/75, 196, 199, 251, 72/365, 366, 375, 376, 379, 414, 417, 419, 422; 204/12, 281; 198/342

[56] References Cited

U.S. PATENT DOCUMENTS

| | | | |
|---|---|---|---|
| 1,836,368 | 12/1931 | Eppensteiner et al. | 204/281 |
| 2,576,240 | 11/1951 | Rothe | 72/251 |
| 2,578,968 | 12/1951 | Cook et al. | 204/281 |
| 3,051,216 | 8/1962 | Tomka et al. | 72/422 |
| 3,096,808 | 7/1963 | Holsteyn | 72/420 |
| 3,661,756 | 5/1972 | Spoon | 204/281 |
| 3,696,656 | 10/1972 | Nara et al. | 72/422 |

FOREIGN PATENT DOCUMENTS

| | | | |
|---|---|---|---|
| 704009 | 2/1965 | Canada | 204/281 |
| 723220 | 7/1942 | Fed. Rep. of Germany | 72/414 |

*Primary Examiner*—Lowell A. Larson
*Attorney, Agent, or Firm*—Brooks Haidt Haffner & Delahunty

[57] ABSTRACT

In the method of the invention starting sheets are stiffened and straightened by pressing or rolling upon the sheet various stiffening patterns projecting from the plane of the sheet, the starting sheet being rolled or pressed from both sides by means of a roller or a press the opposite surfaces of which have the patterns, while the starting sheet is suspended by its lugs.

An apparatus is disclosed having conveyors for conveying the starting sheets and a roller or press for embossing stiffening patterns upon the starting sheets, the roller or press having two parallel rollers or press plates, provided with regularly alternating depressions and corresponding protrusions, at least one of the press plates being movable in the lateral direction, the roller or press being mounted below the suspension conveyor for the starting plates in such a manner that a starting sheet suspended by its lugs from the suspension conveyor passes through the roller or press.

6 Claims, 11 Drawing Figures

METHOD FOR THE STIFFENING AND STRAIGHTENING OF STARTING SHEETS

BACKGROUND OF THE INVENTION

The present invention relates to a method for stiffening and straightening starting sheets by embossing upon the sheet patterns projecting from its plane, and to an apparatus for carrying out the method according to the invention.

For example, the electrolytic refining of copper is carried out by casting impure raw copper into about 40-mm-thick anodes, which dissolve in the electrolyte in the electrolytic cell, and the pure copper is deposited on starting sheets situated between the raw-copper anodes. These starting sheets are thin sheets, in this case copper sheets, having a thickness of approximately 0.4–1.2 mm and a relatively large surface area. For this reason, the starting sheets are very brittle and have to be handled with care so that they will not buckle or bend. The straighter the starting sheets are when they are fitted in the electrolytic cell and the closer the electrodes can be fitted in relation to each other, the higher the capacity of the electrolytic cell. For this reason, it is very important that the thin and brittle starting sheets can be straightened and kept straight during their handling, which includes the attaching of the lugs to the starting sheets and the transfer of the starting sheets into the electrolytic tank.

It is previously known to emboss upon the starting sheet stiffening patterns projecting from its plane, either by pressing or rolling the starting sheet by means of a roller or a press, the opposite surfaces of which have the said patterns for stiffening and straightening the sheet, whereafter the stiffened starting sheets are provided with lugs and are lifted up into a verticle position.

Furthermore, it is known from U.S. Pat. No. 3,544,431 to remove the starting sheets during the process from the electrolytic tank after a suitably thick layer has been deposited on them and to cold work the starting sheets in a press, whereafter the thus straightened sheets are returned to the electrolytic tank for depositing until the final thickness is obtained.

All the methods and apparatus mentioned above have the disadvantage that the sheets cannot be aligned in relation to the lugs. Consequently, when the sheets are lifted up into the vertical position to hang by their lugs, the plane of the sheet can deviate more or less from the vertical direction. In addition, the sheet may be bent and distorted when it is lifted up to hang by its lugs.

The method disclosed in U.S. Pat. No. 3,544,431 has the further disadvantage that the removal of the starting sheet from the electrolytic tank for intermediate straightening is a complicated and expensive step, which can be eliminated in accordance with the present invention.

The object of the present invention is thus to provide a method and apparatus for the stiffening and straightening of starting sheets, wherein the above-mentioned disadvantages have been eliminated and stiffening patterns projecting from the plane of the sheet are embossed upon the starting sheet in such a manner that the starting sheet can at the same time be aligned in relation to the lugs, and wherein the attaching of the lugs and the transfer of the starting sheet into the electrolytic tank do not produce any additional strains or distortion or unevenness in the starting sheet. By means of the present invention it is thus possible to fit the electrodes closer to each other than previously, and thereby to increase the capacity of the electrolytic tank.

A further object of the present invention is to provide a stiffer starting sheet than previously by embossing upon it improved stiffening patterns, the height of which from the plane of the starting sheet is, however, so small that no risk of a short circuit is produced.

SUMMARY OF THE INVENTION

According to the present invention, the starting sheet is pressed or rolled while the starting sheet is hanging by its lugs. In this manner the starting sheet can be not only stiffened and straightened but also aligned in relation to the lugs, and as a result, all the starting sheets hanging by their lugs in the electrolytic tank will be substantially parallel, and therefore they can be placed as close to each other as possible without the risk of a short circuit. It should be pointed out as a further advantage that the starting sheets can now be transferred by their lugs from the press or roller into the electrolytic tank, and thus beyond the press or the roller the starting sheets are no longer subjected to any deforming strain, such as being lifted up or the like.

DESCRIPTION OF THE PREFERRED EMBODIMENTS

According to a preferred embodiment of the present invention, regularly alternating depressions and protrusions are embossed upon the sheet, their height from the plane of the sheet being at maximum approximately 2.5 mm. An especially stiff sheet is obtained by embossing conical depressions and protrusions upon the sheet.

Figure 1:
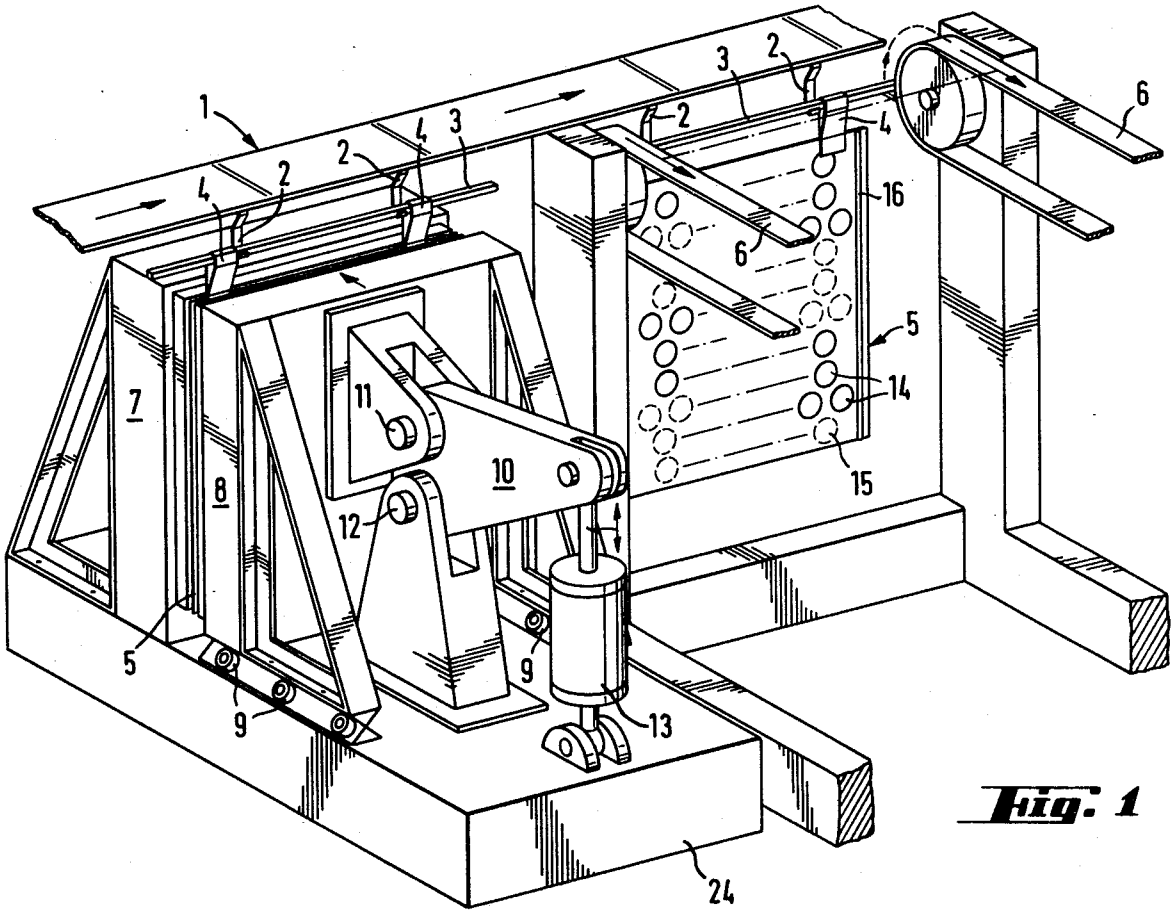
FIG. 1 depicts a perspective view of a preferred apparatus for carrying out the method according to the invention.

As seen from FIG. 1, the starting plates 5 are conveyed in the direction of their plane by an endless conveyor 1, which has support hooks 2, from which the starting sheets 5 are suspended. Two support lugs 4 have been attached to the upper edge of each starting sheet 5 at a distance from each other. A suspension bar 3 has been passed through these support lugs 4, and the starting sheet 5 is suspended by this bar 3 from the support hooks 2 of the conveyor 1.

Below the conveyor 1 and on both its sides there has been fitted a press in such a manner that the starting sheets 5 being conveyed by the conveyor 1 come to pass between the press plates 7 and 8 of the press. The press has been mounted on a stationary base 24 in such a manner that one press plate 7 is stationary and the opposite press plate 8 is reciprocatingly movable towards the stationary press plate 7 and away from it. The movable press plate 8 moves on rollers 9 fitted on the stationary base 24, and the moving is effected by means of a lever arm 10, which has been connected to the movable press plate 8 by means of an articulation 11 and to the stationary base 24 by means of an articulation 12, and the free end of which has been connected, by means of an actuating cylinder 13, to the stationary base 24 in such a manner that the press plate 8 can be reciprocatingly moved by changing the effective length of the actuating cylinder 13.

Behind the press, as seen in the travel direction of the conveyor 1, there has been fitted a transverse conveyor 6, which grips a pressed and straightened starting plate 5 emerging from the press and transfers it, in a direction perpendicular to the plane of this starting sheet, into a starting-sheet cassette (not shown). In the starting-sheet cassette, the starting sheets are fitted at a predetermined distance from each other, and the number of sheets required by one electrolytic tank is lifted from it in one batch into the electrolytic tank.

The starting sheet 5 is brought between the press plates 7 and 8 by the conveyor 1. At this time the press is open, and the press is closed only after the starting sheet 5 has stopped between the press plates 7 and 8. When the conveyor 1 is not moving and the starting sheet 5 is between the press plates 7 and 8, the actuating cylinder 13 starts working, and then its effective length increases and the lever arm 10 turns, transferring the press plate 8 supported by rollers 9 towards the stationary press plate 7. The pressing force of the press can be approximately 80 metric tons, and the opposite surfaces of the press plates 7 and 8 have suitable depressions and corresponding protrusions, so that various stiffening patterns are formed in the starting sheet, while the starting sheet 5 straightens and its plane becomes precisely aligned in relation to the lugs 4. In this manner, the plane of each starting sheet 5 is parallel in relation to the lugs 4, and thus the starting sheets will be precisely parallel in the electrolytic tank. After the pressing, the effective length of the actuating cylinder 13 decreases, whereby the lever arm 10 is turned in the opposite direction and the press plate 8 moves away from the stationary press plate 7. After the press has opened, the conveyor 1 re-starts and transfers the stiffened and straightened as well as precisely aligned, starting sheet 5 to the receiving end of the conveyor 6. Between the press and the electrolytic tank, the starting sheet 5 is moved along only suspended by the suspension bar 3 and the lugs 4, and thus the starting sheet is not subjected to any strains which could change its shape or its position in relation to the lugs 4. In this manner, it is ensured that the starting sheets 5 are exactly parallel when they arrive in the electrolytic tank.

Figure 3:
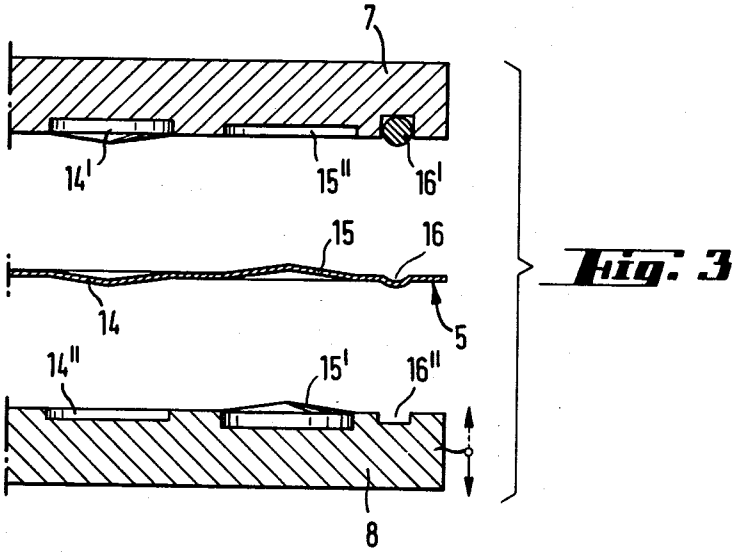
FIG. 3 depicts a cross-sectional partial view of the starting sheet according to FIG. 2 and of the press plates used for embossing it.
Figure 2:
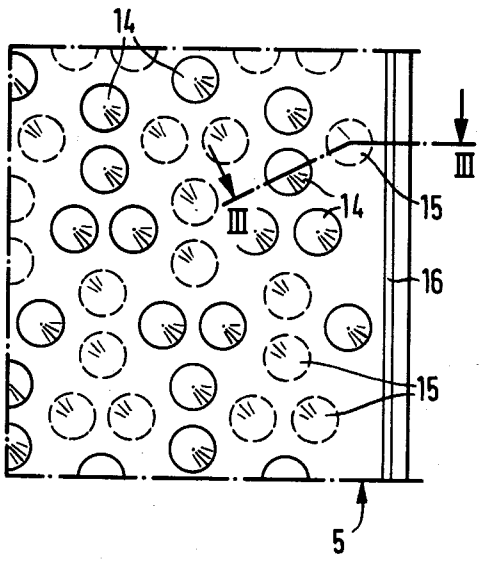
FIG. 2 depicts a section of a starting plate stiffened by the method according to the invention, having regularly alternating conical depressions and protrusions.

FIGS. 2 and 3 depict one especially advantageous pattern for starting sheets 5, by means of which an especially stiff structure is achieved, and they also show the press plates 7 and 8 used for producing the pattern. The protrusions are indicated by 14 and the depressions by 15, and the ridge running along both side edges of the starting sheet, parallel to the side edge and at a small distance from it, is indicated by 16. The protrusions 14 and the depressions 15 are of the same shape, and they are produced by means of conical protrusions 14' in the press plate 7 and corresponding depressions 14'' in the movable press plate 8, and the depressions 15 are produced by means of conical protrusions 15' in the movable press plate 8 and corresponding depressions 15'' in the stationary press plate. The height of the conical protrusions 14' and 15' from the plane of the press plates is 2.5 mm and the depth of the depressions 14'' and 15'' from the plane surface of the press plates 7 and 8 is respectively 2.5 mm plus the thickness of the starting sheet. For producing a ridge 16 parallel to the vertical side edges of the starting sheet 5, the stationary press plate 7 has a bar 16' with a round cross section, embedded next to the opposite vertical edges of the plate 7, the movable press plate 8 having a corresponding depression 16'' in the corresponding position.

Figure 5:
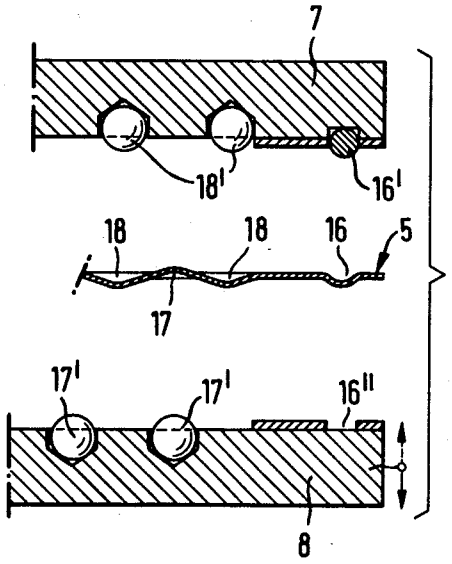
FIG. 5 depicts a cross-sectional partial view of the starting sheet according to FIG. 4 and of the press plates used for pressing it.
Figure 4:
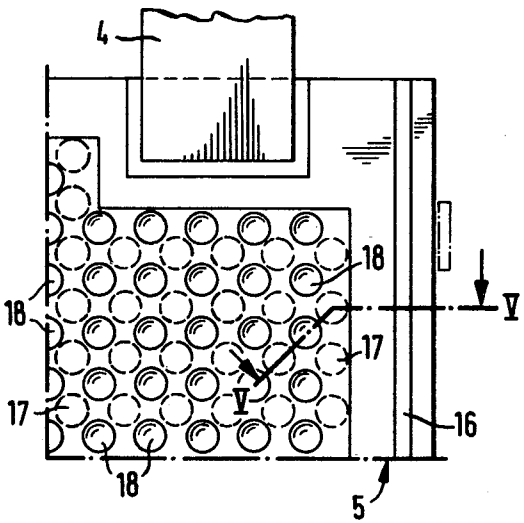
FIG. 4 depicts a partial view of another starting sheet produced by the method according to the invention, having regularly alternating spherical depressions and protrusions.
Figure 8:
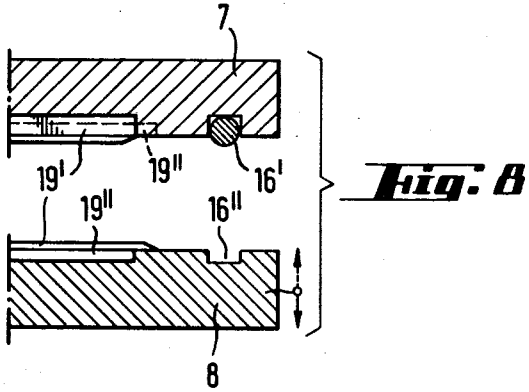
FIG. 8 is a cross-sectional partial view of the press plates used for pressing the starting sheet of FIG. 6, cut along line VIII—VIII in FIG. 6.

In the starting sheets depicted in FIGS. 4 and 5, the depressions and protrusions are indicated by 17 and 18, and they are spherical, which shape has been produced by means of balls 17' and 18' embedded in the press plates 7 and 8, the balls having been positioned in dislocation in relation to the balls in the opposite press plate and project so much from the plane of their respective press plates that protrusions 17 and depressions 18, 2.5 mm high, are formed in the starting sheets 5 when the press plates 7 and 8 are pressed against each other.

Figure 7:
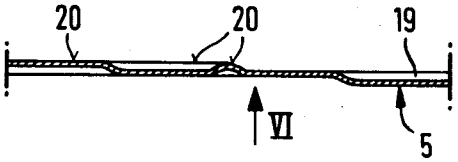
FIG. 7 is a section along line VII—VII in FIG. 6.
Figure 6:
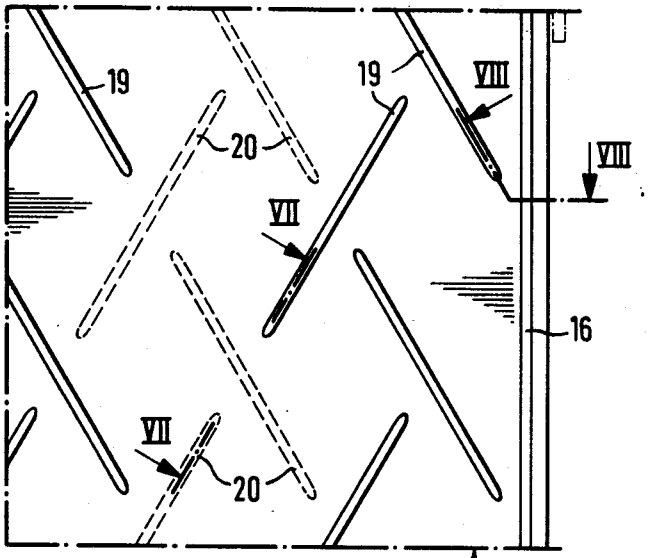
FIG. 6 depicts a partial view of a third starting sheet stiffened by the method according to the invention, having regularly alternating grooves and ridges, which are at an angle in relation to each other.

In the starting sheet 5 depicted in FIGS. 6 and 7, several oblong grooves 19 and ridges 20 have been embossed upon the starting sheet 5, the grooves and ridges being at an angle of 60° in relation to each other and to the edges of the sheet 5. In this manner, a waffle pattern has been produced and it stiffens the starting sheet 5 effectively. The grooves 19 and the ridges 20 have been produced by means of bars 19' with a round cross section, embedded in the press plate 7 and 8, the bars 19' mating with depressions 19'' in the oppositive press plate.

Figure 10:
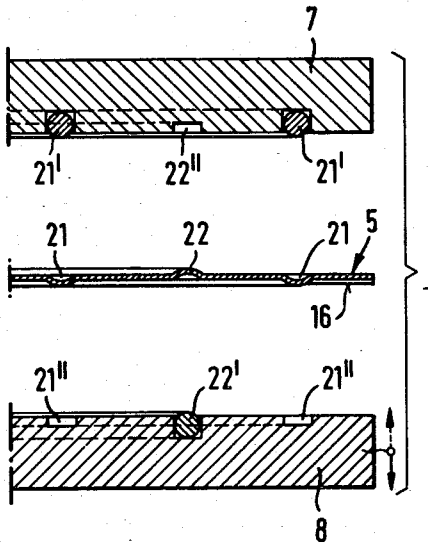
FIG. 10 depicts a cross-sectional partial view of the starting sheet according to FIG. 9 and of the press plates used for pressing it.
Figure 9:
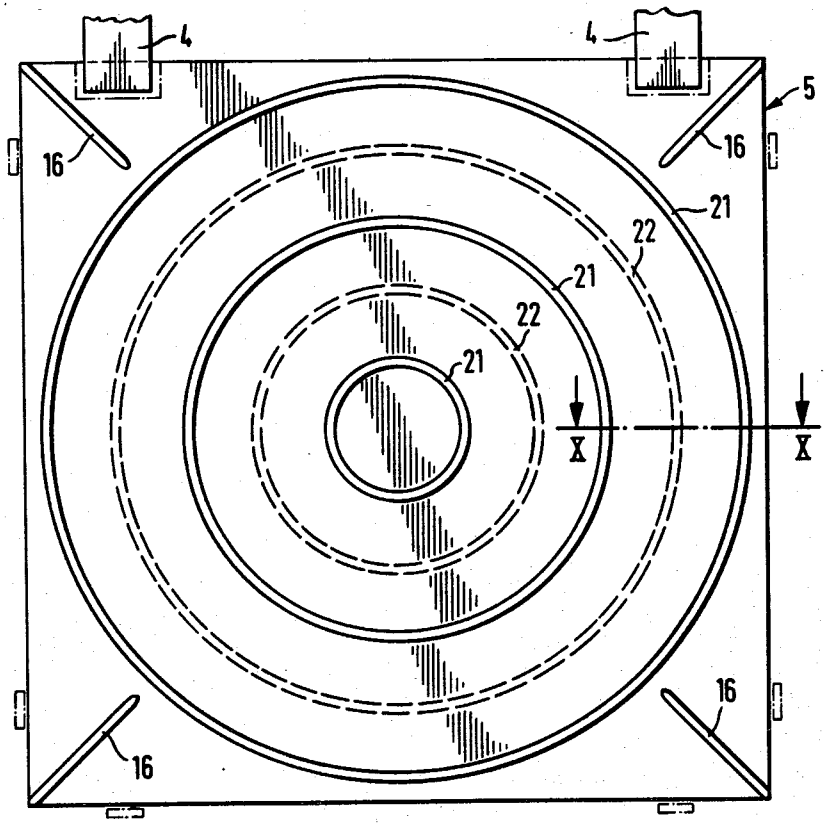
FIG. 9 depicts one alternative starting sheet produced by the method according to the invention, having regularly alternating concentric circular grooves and ridges.

Finally, FIGS. 9 and 10 depict a starting sheet 5, in which several concentric circular grooves 21 and ridges 22 have been formed at a distance from each other. The grooves 21 and the ridges 22 have in this case also been produced by means of bars with a round cross section, embedded in the press plates 7 and 8, the bars projecting from the plane of the press plates 7 and 8 and mating with corresponding depressions in the opposite press plate.

It is evident that very different patterns can be embossed upon starting sheets for stiffening the sheets, and that the above-mentioned stiffening patterns are only examples. What is essential in the present invention is that the stiffening patterns are embossed upon the starting sheet while the sheet is hanging by its lugs 4, supported by suspension bar 3, from the support hooks 2 of the conveyor 1, and that the thereby stiffened and straightened starting sheet 5, aligned in relation to its lugs, is thereafter transferred into the electrolytic cell in a suspended position.

Figure 11:
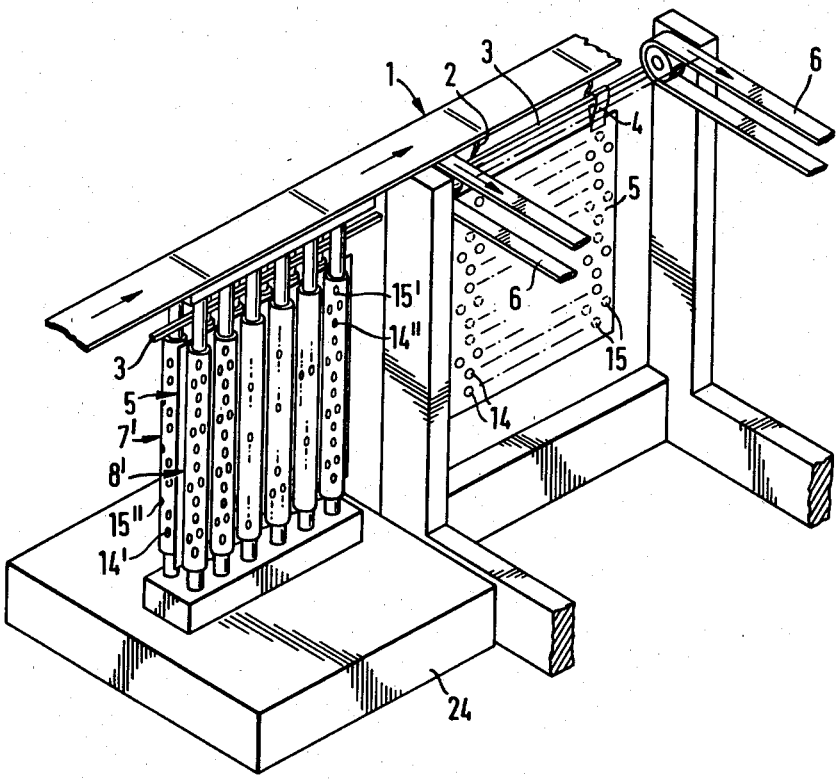
FIG. 11 depicts a perspective view of an alternative apparatus for carrying out the method according to the invention.

The apparatus depicted in FIG. 11 deviates from the apparatus of FIG. 1 in that the press has been replaced with rollers 7' and 8', which have been mounted in a vertical position below the conveyor 1 in two rows on both sides of the conveying track of the starting sheet 5 in such a manner that the starting sheet 5 hanging freely by a suspension bar 3 and lugs 4 from the support hooks 2 of the conveyor passes between the rollers 7' and 8', the rollers having the above-mentioned protrusions and depressions for stiffening and straightening the starting sheet 5 and for aligning it in relation to the lugs 4.

What is claimed is:

1. A method for producing a stiffened and straightened starting sheet of the type having a major planar surface area, a sheet thickness of approximately 0.4 to 1.2 mm and a stiffening pattern projecting at maximum approximately 2.5 mm from the plane defined by said planar surface area and provided with suspension lugs attached to one sheet edge, comprising first attaching said suspension lugs to the sheet, then suspending the sheet from said lugs in a vertical orientation and continuing to suspend the sheet from said lugs while rolling or pressing the sheet to produce said stiffening pattern therein and to simultaneously align said plane with said lugs to assure that the sheet produced will hang straight down from said lugs.

2. A method according to claim 1, in which regularly alternating depressions and protrusions are embossed upon the sheet.

3. A method according to claim 1, in which conical depressions and protrusions are embossed upon the sheet.

4. A method according to claim 1, in which spherical depressions and protrusions are embossed upon the sheet.

5. A method according to claim 1, in which narrow, oblong grooves and ridges are embossed upon the sheet, the grooves and ridges being at an angle of about 60°-90° in relation to the grooves and ridges closest to their ends, and to the edges of the sheet.

6. A method according to claim 1, in which concentric circular grooves and ridges are embossed upon the sheet.

* * * * *